US008574093B2

(12) United States Patent
Sato et al.

(10) Patent No.: US 8,574,093 B2
(45) **Date of Patent: *Nov. 5, 2013**

(54) GOLF CLUB HEAD AND GOLF CLUB

(75) Inventors: Fumiaki Sato, Chichibu (JP); Hiroshi Takahashi, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 207 days.

This patent is subject to a terminal disclaimer.

(21) Appl. No.: 12/944,297

(22) Filed: Nov. 11, 2010

(65) Prior Publication Data

US 2011/0118044 A1 May 19, 2011

(30) Foreign Application Priority Data

Nov. 13, 2009 (JP) ..... 2009-259920

(51) Int. Cl.
*A63B 53/02* (2006.01)

(52) U.S. Cl.
USPC ..... 473/288; 473/307; 473/246

(58) Field of Classification Search
USPC ..... 473/288, 307, 244–248
See application file for complete search history.

(56) References Cited

U.S. PATENT DOCUMENTS

| | | | | |
|---|---|---|---|---|
| 1,540,559 | A | 6/1925 | Murphy | |
| 2,067,556 | A | 1/1937 | Wettlaufer | |
| 2,219,670 | A * | 10/1940 | Wettlaufer | 473/247 |
| 4,169,728 | A * | 10/1979 | Takeuchi et al. | 420/532 |
| 7,083,529 | B2 | 8/2006 | Cackett et al. | |
| 7,326,126 | B2 | 2/2008 | Holt et al. | |
| 7,335,113 | B2 | 2/2008 | Hocknell et al. | |
| 7,344,449 | B2 | 3/2008 | Hocknell et al. | |
| 7,476,160 | B2 | 1/2009 | Hocknell et al. | |
| 7,530,900 | B2 * | 5/2009 | Holt et al. | 473/307 |
| 7,651,407 | B2 * | 1/2010 | Tsai et al. | 473/306 |
| 7,997,997 | B2 * | 8/2011 | Bennett et al. | 473/288 |
| 8,142,306 | B2 * | 3/2012 | De La Cruz et al. | 473/288 |
| 2004/0018886 | A1 | 1/2004 | Burrows | |

(Continued)

FOREIGN PATENT DOCUMENTS

| | | |
|---|---|---|
| JP | 6439766 U | 3/1989 |
| JP | 4156869 A | 5/1992 |

(Continued)

OTHER PUBLICATIONS

Notification of Reasons for Refusal, dated Jul. 30, 2013, issued by the Japanese Patent Office in counterpart Japanese Application No. 2009-259920.

*Primary Examiner* — Stephen L. Blau
(74) *Attorney, Agent, or Firm* — Sughrue Mion, PLLC

(57) ABSTRACT

A golf club head includes: a head main body having a shaft holder inserting hole; a shaft holder which has a shaft inserting hole and is attachably and detachably installed in the shaft holder inserting hole; a bolt inserting hole which penetrates from a sole side of the head main body to the shaft holder inserting hole; and a bolt which is inserted into the bolt inserting hole, screwed into the shaft holder, and fixes the shaft holder to the head main body, an axis center of the shaft inserting hole and an axis center of the shaft holder inserting hole being non-coaxial shapes, wherein a lower end side of the shaft holder and an inner portion of the shaft holder inserting hole are polygonal sectional shape portions and are engaged with each other.

20 Claims, 8 Drawing Sheets

(56) References Cited

U.S. PATENT DOCUMENTS

| | | | | |
|---|---|---|---|---|
| 2007/0117645 | A1* | 5/2007 | Nakashima | 473/288 |
| 2008/0254909 | A1* | 10/2008 | Callinan et al. | 473/307 |
| 2008/0280693 | A1* | 11/2008 | Chai | 473/288 |
| 2009/0062029 | A1* | 3/2009 | Stites et al. | 473/288 |
| 2009/0156323 | A1* | 6/2009 | Yamamoto | 473/288 |
| 2010/0151959 | A1* | 6/2010 | Summitt | 473/307 |
| 2011/0195798 | A1* | 8/2011 | Sander et al. | 473/307 |

FOREIGN PATENT DOCUMENTS

| | | | | |
|---|---|---|---|---|
| JP | 9084903 | A | | 3/1997 |
| JP | 9117535 | A | | 5/1997 |
| JP | 2000005349 | A | | 1/2000 |
| JP | 2005270402 | A | | 10/2005 |
| JP | 2005533626 | A | | 11/2005 |
| JP | 200642951 | A | | 2/2006 |
| JP | 2006042951 | A | * | 2/2006 |
| JP | 2008520274 | A | | 6/2008 |

* cited by examiner

GOLF CLUB HEAD AND GOLF CLUB

BACKGROUND

1. Field of the Invention

The present invention relates to a golf club and a head thereof. Particularly, the present invention relates to a golf club and a head thereof capable of easily performing control of properties such as a lie angle, a slice angle and an amount of face progression.

2. Description of the Related Art

The golf club has a head attached to a front end portion of a shaft. A grip is installed in a proximal end portion of the shaft.

In a general golf club head of the related art, a hosel port is directly provided on the head, and a shaft is inserted into the hosel port and is fixed by an adhesive. In addition, as the adhesive, an epoxy-based adhesive is generally used. When the shaft is exchanged, the shaft is pulled out by heating the hosel portion to destroy a structure formed of an epoxy resin hardening product.

In JP-A-2000-5349, there is described a golf club in which a hosel joint is bonded to the front end of the shaft, the hosel joint is inserted into the hosel hole of the golf club head, and the hosel joint is fixed to the golf club head by a bolt inserted from a sole side. JP-A-2000-5349 shows a golf club head in which a loft angle and the lie angle can be adjusted by slightly tilting the shaft with respect to the hosel joint.

In the golf club head of JP-A-2000-5349, a cross section, which is perpendicular to an axis center of the hosel joint and the hosel hole, has a circular shape. For that reason, a direction (hereinafter called "phase") of the hosel joint in a circumferential direction can be arbitrarily controlled. However, when the phase has changed, an original phase becomes un known, whereby, even though it is thought that the control of a direction of the original phase is satisfactory, it is difficult to accurately return to (reproduce) the original phase.

SUMMARY

In order to solve the above-mentioned problem, an object of the present invention is to provide a golf club and a head that can perform positioning of a shaft holder and can control properties such as a lie angle, a slice angle and an amount of face progression (i.e. a distance between an axis center of the shaft to a leading-edge of a face portion) with good reproductivity.

According to an aspect of the invention, there is provided a golf club head including: a head main body having a shaft holder inserting hole; a shaft holder which has a shaft inserting hole and is attachably and detachably installed in the shaft holder inserting hole; a bolt inserting hole which penetrates from a sole side of the head main body to the shaft holder inserting hole; and a bolt which is inserted into the bolt inserting hole, screwed into the shaft holder, and fixes the shaft holder to the head main body, an axis center of the shaft inserting hole and an axis center of the shaft holder inserting hole being non-coaxial shapes, wherein a lower end side of the shaft holder and an inner portion of the shaft holder inserting hole are polygonal sectional shape portions and are engaged with each other.

The axis center of the shaft inserting hole may be parallel to the axis center of the shaft holder inserting hole, and the axis center of the shaft inserting hole may be separated from the axis center of the shaft holder inserting hole by a predetermined distance.

The axis center of the shaft inserting hole may be inclined with respect to the axis center of the shaft holder inserting hole.

An inner peripheral surface of an upper portion of the shaft holder inserting hole and an outer peripheral surface of an upper portion of the shaft holder may be respectively cylindrical portion, and lower sides of the cylindrical portions may be regular polygonal pyramid portions that shrink toward a lower part.

The golf club head may further include an elastic body interposed between the regular polygonal pyramid portion of the shaft holder and the regular polygonal pyramid portion of the shaft holder inserting hole.

The golf club head may further include a flange provided on the upper part of the shaft holder, the flange being in contact with a peripheral edge portion of the shaft holder inserting hole.

The golf club head may further include convex portions protrude from one side of the peripheral edge portion of the shaft holder inserting hole and the lower surface of the flange toward the other side thereof, and concave portions engaged with the convex portions are formed on the other side, wherein the convex portions and the concave portions are respectively provided with gaps in a circumferential direction of the shaft holder inserting hole.

The convex portions and the concave portions may be respectively provided in the same numbers as those of angles of polygonal section shape portions of a lower end side of the shaft holder and an inner portion of the shaft holder inserting hole.

The head main body may be formed of stainless or titanium alloy, and the shaft holder may be aluminum alloy and may be formed with a hard coating by anodic treatment.

According to another aspect of the invention, there is provided a golf club including: a shaft; a golf club head including: a head main body having a shaft holder inserting hole; a shaft holder which has a shaft inserting hole and is attachably and detachably installed in the shaft holder inserting hole; a bolt inserting hole which penetrates from a sole side of the head main body to the shaft holder inserting hole; and a bolt which is inserted into the bolt inserting hole, screwed into the shaft holder, and fixes the shaft holder to the head main body, an axis center of the shaft inserting hole and an axis center of the shaft holder inserting hole being non-coaxial shapes, wherein: a lower end side of the shaft holder and an inner portion of the shaft holder inserting hole are polygonal sectional shape portions and are engaged with each other; and a front end of the shaft is inserted and fixed to the shaft inserting hole of the golf club head.

In the golf club and the head thereof of the present invention, a shaft holder is attachably and detachably installed in a head main body by a bolt, and a shaft is fixed to a shaft inserting hole of the shaft holder. Since an axis center of the shaft inserting hole is not coaxial with an axis center of the shaft holder, by changing the phase of the shaft holder, the lie angle, the slice angle or the amount of face progression can be controlled.

For example, in the case of a shaft holder in which the axis center of the shaft is in a slope direction (e.g., slope intersecting direction) with respect to the axis center of the shaft holder inserting hole, the lie angle or the slice angle is changed by changing the phase of the shaft holder.

Thus, in a golf club including the same shafts and the same head main bodies, it is possible to control only the lie angle or the slice angle.

In addition, in the case of a shaft holder in which the position of the axis center of the shaft holder inserting hole deviates from the position of the axis center of the shaft inserting hole in the shape of a parallel movement, by changing the phase of the shaft holder, in the golf club including the same shaft and the same head main body, it is possible to control the amount of face progression.

Furthermore, in the present invention, it is also possible to exchange the shaft with the shaft holder to exchange the shaft. That is, the same shaft holders are prepared as the shaft holder, a special shaft is fixed to the shaft holder to make a connection body of the shaft holder and the shaft, and the connection body of shaft holder and the shaft is exchanged with the present connection body of shaft holder and the shaft to attach the same to the shaft inserting hole of the head, whereby it is possible to obtain the golf club in which only the shaft differs.

According to the shaft exchanging method, the structure of the adhesive is destroyed by heating to detach the shaft, so that it is possible to eliminate a cumbersome task and time in which a new shaft is attached with an adhesive again. For that reason, the connection body of shaft holder and the shaft are detached from the head of the golf club which has just been subjected to trial shot, and a separate connection body of shaft holder and the shaft with a different property can be attached to the head to instantly perform the trial shot. Thus, it is extremely easy for a golfer to find out a suitable golf club in a golf shop or the like. In addition, it is possible to perform the estimation of the shaft without considering individual difference.

Recently, in order that a golfer find a golf club which is fitted to own ability, a system has been developed which finds a golf club by the use of a computer, a high speed camera or the like. This system is a system which finds the individual available clubs by comparing a strike to the base on the basis of a head speed, a striking angle or the like.

On the contrary, according to the golf club of the present invention, only the positional relationship of the same shaft and the head can be changed to change a center distance or a progression and a difference in a ball flight property (a striking angle or a spin) of the struck ball can easily be felt, or only the shaft can be exchanged with respect to the same head to feel only the difference in shaft. Furthermore, the shaft can be exchanged according to a condition of a player, or in order to adjust the lie angle or the slice angle and the amount of face progression while the shaft remains identical, it is possible to change the attachment direction of the shaft relative to the head.

In the present invention, since a lower end side of the shaft holder and an inner portion of a shaft holder inserting hole are formed in the shape of a polygonal section, the positioning (phase determination) of the hosel in the circumferential direction is performed with good reproductivity. Furthermore, a rotation between the head and the shaft holder is prevented.

When an elastic body is interposed between the lower end of the shaft holder and the inner surface portion of the shaft holder inserting hole, an impact or a vibration between the shaft holder inserting hole and the shaft holder is absorbed.

In a case where it is configured so that a flange is provided on a upper part of the shaft holder, and the flange comes into contact with a peripheral edge portion of the shaft holder inserting hole, convex portions protrude from one side of the peripheral edge portion of the shaft holder inserting hole and the lower surface of the flange toward the other side, and the convex portions are engaged with concave portions provided on the other side thereof, whereby a rotation prevention effect of the shaft holder in a direction around the axis center of the shaft, that is, a fixing rigidity of the shaft holder in a torque direction is improved.

In this case, it is desirable that the convex portions and the concave portions be provided in the same numbers as the numbers of the angles of the polygonal section shape portions of the lower end side of the shaft holder and the inner portion of the shaft holder inserting hole, with gaps in the circumferential direction of the shaft holder inserting hole. In this case as configured above, by matching the phase of the shaft holder so that each convex portion of one side of the peripheral edge portion of the shaft holder inserting hole and the lower surface of the flange confronts each concave portion of the other side thereof to insert the shaft holder into the shaft holder inserting hole, the polygonal section shape portions of the lower end side of the shaft holder and the inner portion of the shaft holder inserting hole are automatically engaged with each other. As a result, when the lower end side of the shaft holder is inserted into the shaft holder inserting hole, even if it is difficult to confirm the polygonal section shape portions, the phase matching of the shaft holder can easily be performed while looking the convex portion and the concave portion.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Figure 1:
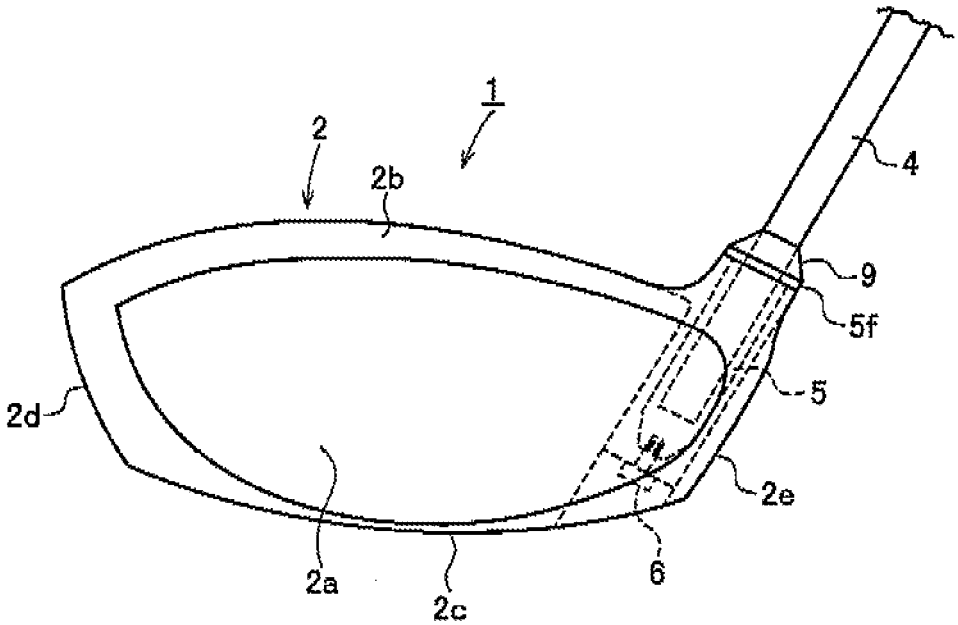
FIG. 1 is a front view of a head relating to a first embodiment.
Figure 2:
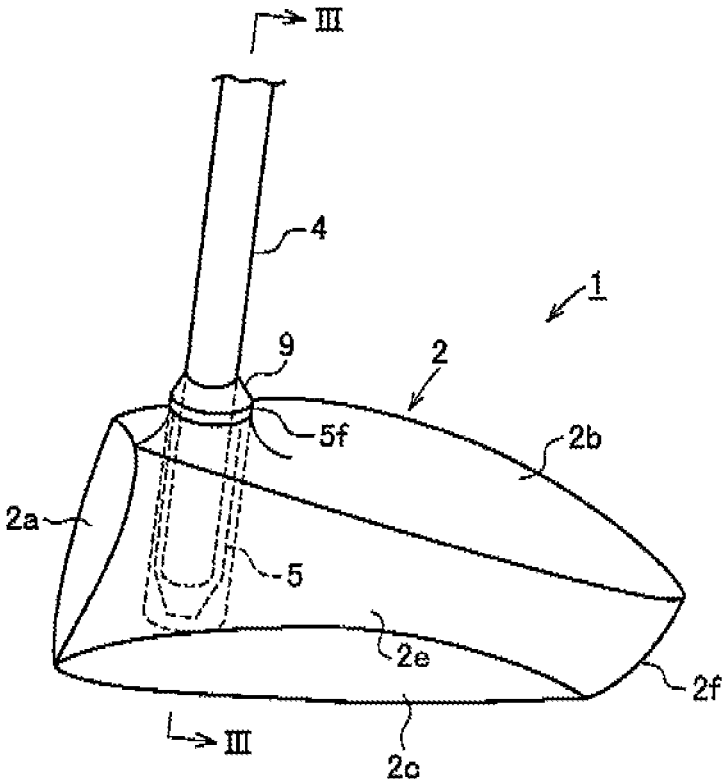
FIG. 2 is a side view of a head in which a shaft is eccentric with respect to a center of a shaft holder axis.
Figure 3:
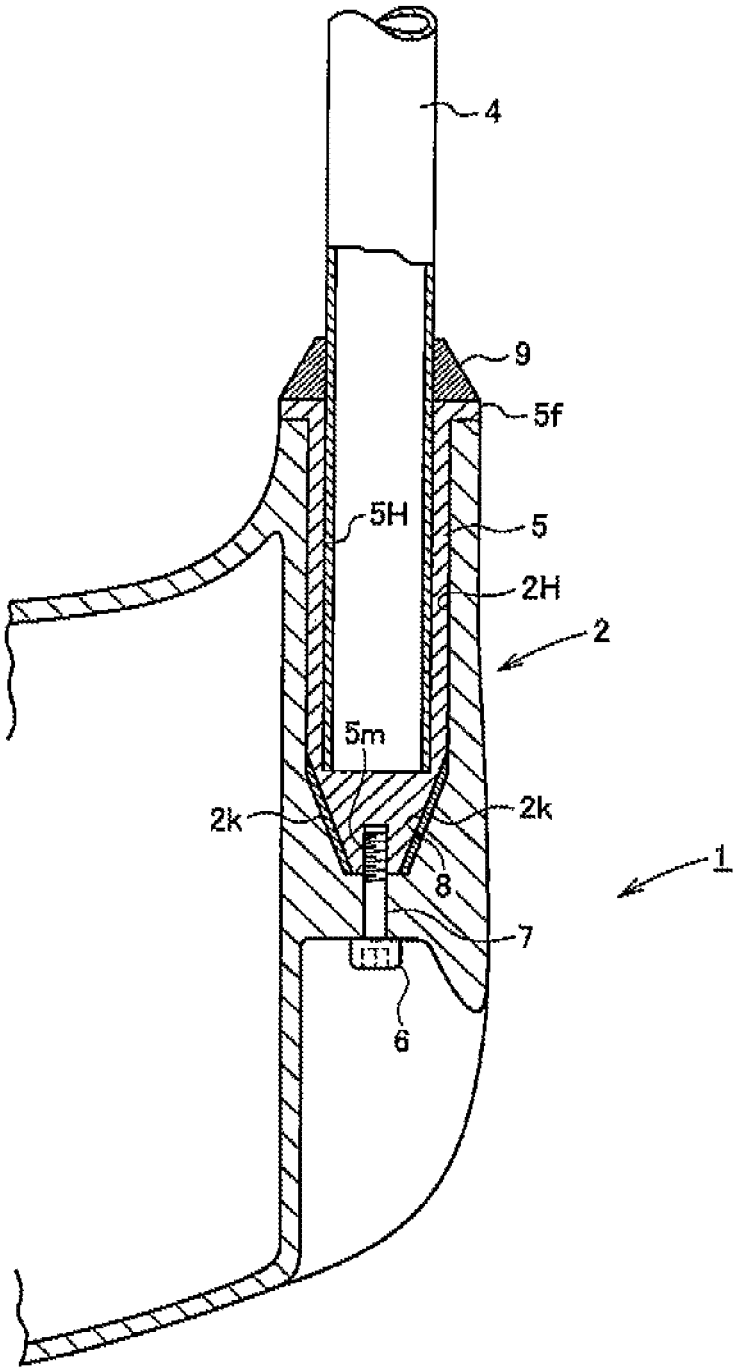
FIG. 3 is a sectional view taken from line in FIG. 2.
Figure 4:
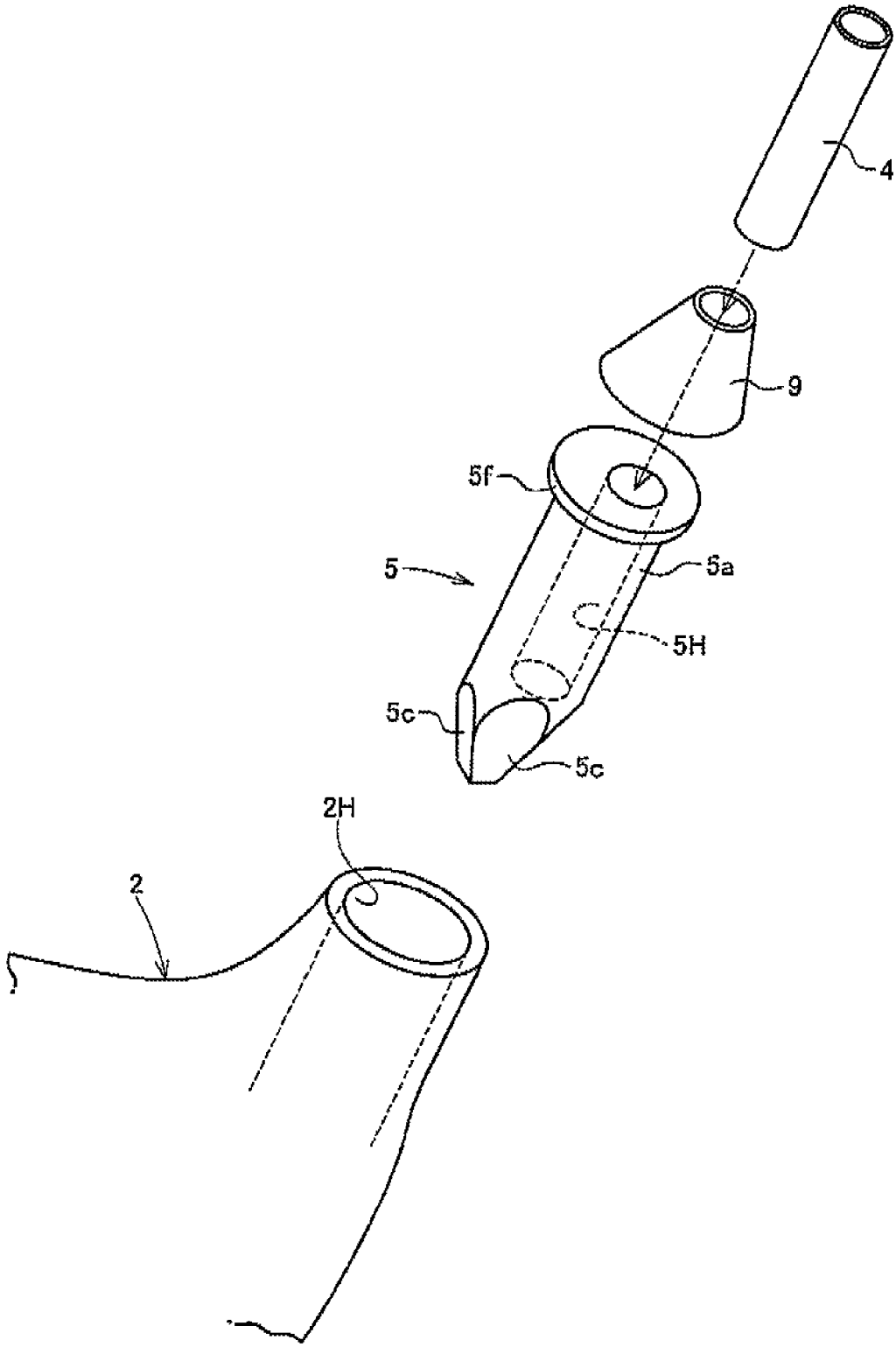
FIG. 4 is a perspective view of a hosel, a shaft holder and screw member.

Hereinafter, a first embodiment will be described with reference to FIGS. 1 to 4. FIG. 1 is a front view of a golf club relating to a first embodiment. FIG. 2 is a side view of the golf club. FIG. 3 is a sectional view taken from line in FIG. 2. FIG. 4 is a perspective view of a hosel, a shaft holder, screw member and a shaft front end portion.

The golf club is one in which a shaft holder 5 with a shaft 4 attached to a head 1 via a bolt 6.

The head 1 has a head main body 2, and the shaft holder 5 which is attachably and detachably attached to the head main body 2. The head 1 is a hollow wood type, and has a face portion 2*a*, a crown portion 2*b*, a sole portion 2*c*, a toe portion 2*d*, a heel portion 2*e*, and a back portion 2*f*.

As shown in FIG. 3, on a side of the crown portion 2*b* facing the face portion 2*a* or the heel portion 2*e*, a shaft hole inserting hole 2H is provided. The shaft hole inserting hole 2H has a cylindrical shape in which an upper end thereof is opened and an lower end thereof is closed, and extends toward the inserting direction of the shaft 4. An inner peripheral surface of the shaft holder inserting hole 2H is formed by a cylindrical portion except for the lower portion thereof.

An inner peripheral surface on an inner side further than the cylindrical portion of the shaft holder inserting hole 2H has a regular polygon pyramid shape, which is reduced in diameter as it goes to the inner side, and has a plurality of slope surfaces 2*k* (see FIG. 3) intersecting the center of axis of the shaft holder 5 provided therein. It is preferable that an intersecting angle (an included angle) of a pair of opposed slope surfaces 2*k* be about 10 to 30°, in particular, about 15 to 20°.

The shaft holder 5 is inserted into the shaft holder inserting hole 2H from the upper part, and a bolt 6 is screwed into a male screw hole 5*m* of the shaft holder 5 through a bolt inserting hole 7, so that shaft holder 5 is fixed to the shaft holder inserting hole 2H. The bolt inserting hole 7 penetrates from an innermost portion of the shaft holder inserting hole 2H to a sole side of the head main body 2.

The shaft holder 5 is a cylindrical member which is fitted into the shaft holder inserting hole 2H, and a shaft inserting hole 5H for inserting the shaft 4 is provided from an upper end side toward a lower end side thereof. An outer peripheral surface of the shaft holder 5 is a cylindrical portion 5*a* except for the lower part thereof. An inner peripheral surface of the shaft inserting hole 5H has a cylindrical shape as a whole.

It is preferable that an outer diameter of the shaft holder 5 be about 12 to 20 mm, in particular, about 13 to 15 mm, and an inner diameter of the shaft inserting hole 5H be about 8 to 10 mm, in particular, 8.5 to 9.5 mm.

A front end of the shaft 4 may be inserted in to the shaft inserting hole 5H and fixed by an adhesive, so that the shaft 4 and the shaft holder 5 are integrated to form a connection body of shaft holder and the shaft. Preferably, the adhesive is applied to the outer peripheral surface of the front end portion of the shaft 4 and is inserted up to the innermost portion of the shaft inserting portion 5H. As the adhesive, an epoxy-based adhesive is preferable.

The flange 5*f* is provided on the upper end of the shaft holder 5.

On the outer surface of the lower end side of the shaft holder 5, four-sided slope surfaces 5*c*, which form square pyramid shapes (truncated square pyramid shapes) accurately as they go to the lower end, are provided. The slope surfaces 5*c* are symmetrically provided with the axis center of the shaft holder 5 pinched therebetween. An intersecting angle of the pair of opposed slope surfaces 5*c* and 5*c* is the same as the intersecting angle of the slope surfaces 2*k* and 2*k*.

The slope surface 5*c* of the lower portion of the shaft holder 5 and the slope surface 2*k* of the inner side of the shaft holder inserting hole 2H have regular pyramid shapes in the present embodiment, but they may have regular triangular pyramid shapes, regular hexagonal pyramid shapes, regular octagonal pyramid shapes or the like, and preferably, square pyramids to regular octagonal pyramids.

On addition, although it is not shown, a bevel with an angle of about 20 to 45° may be formed on the inner peripheral edge of the upper end side of the shaft inserting hole 5H to easily insert the shaft 4.

In assembling the golf club, as shown in FIG. 4, first of all, the shaft holder 5 is fixed to the front end of the shaft 4 with a ferrule 9 fitted thereto to construct the connection body of the shaft holder and the shaft. The shaft holder 5 of the connection body of the shaft holder and the shaft is inserted to the shaft holder inserting hole 2H. Furthermore, in the present embodiment, the elastic body 8 with a slice shape such as a thin (for example, a thickness of about 0.5 to 5 mm) rubber, elastomer may be provided on the slope surface 5*c* of the shaft holder 5 by painting, gluing or the like. The elastic body 8 may be provided on the shaft holder 5 in advance, and may be provided on the shaft holder 5 after constructing the connection body of the shaft holder and the shaft.

After the shaft holder 5 of the connection body of the shaft holder and the shaft is inserted into the shaft holder inserting hole 2H so as to overlap the slope surface 5*c* and the slope surface 2*k*, the bolt 6 is screwed into the male screw hole 5*m* of the shaft holder 5 through the holder inserting hole 7.

As a result, as shown in FIG. 3, the flange 5*f* is pressed to the outer peripheral edge of the upper end portion of the shaft holder inserting hole 2H, the slope surface 5*c* of the shaft holder 5 is pressed to the slope surface 2*k* of the shaft holder inserting hole 2H via the elastic body 8, and the shaft holder 5 is fixed to the head main body 2. Since the shaft holder 5 and the shaft 4 are fixedly bonded by the adhesive, the golf club with the shaft 4 and the head 1 integrally formed is completed.

Furthermore, in FIGS. 1 to 4, the shaft 4 and the shaft inserting hole 5H are disposed in parallel to and with a predetermined distance gap with respect to the axis center of the shaft holder inserting hole 2H. That is, the shaft 4 is deviated (eccentric) from the axis center position of the shaft holder inserting hole 2H. The axis center of the shaft holder inserting hole 2H and the axis center of the shaft 4 are separated from each other, for example by about 0.5 to 4.0 mm.

FIG. 2 shows a state in which the shaft 4 becomes the outermost face side. By first removing the shaft holder 5 from the shaft holder inserting hole 2H from the state shown in FIG. 2 to rotate by 90°, 180° or 270°, the position of the shaft 4 can be changed to the heel side, the back side or the toe side in a parallel movement state. In FIG. 2, the amount of face progression is the minimum, and in a state of rotating by 180° therefrom, the amount of face progression is the maximum. By rotating the shaft holder 5 by 90° from that state to make the position of the shaft 4 close to the toe side or the heel side, the distance from the shaft axis center to the head center is changed. If the slope surface 5*c* of the shaft holder 5 and the slope surface 2*k* of the shaft holder inserting hole 2H are regular octagonal pyramid shapes, the phase of the shaft holder 5 can be changed by 45°.

Figure 5:
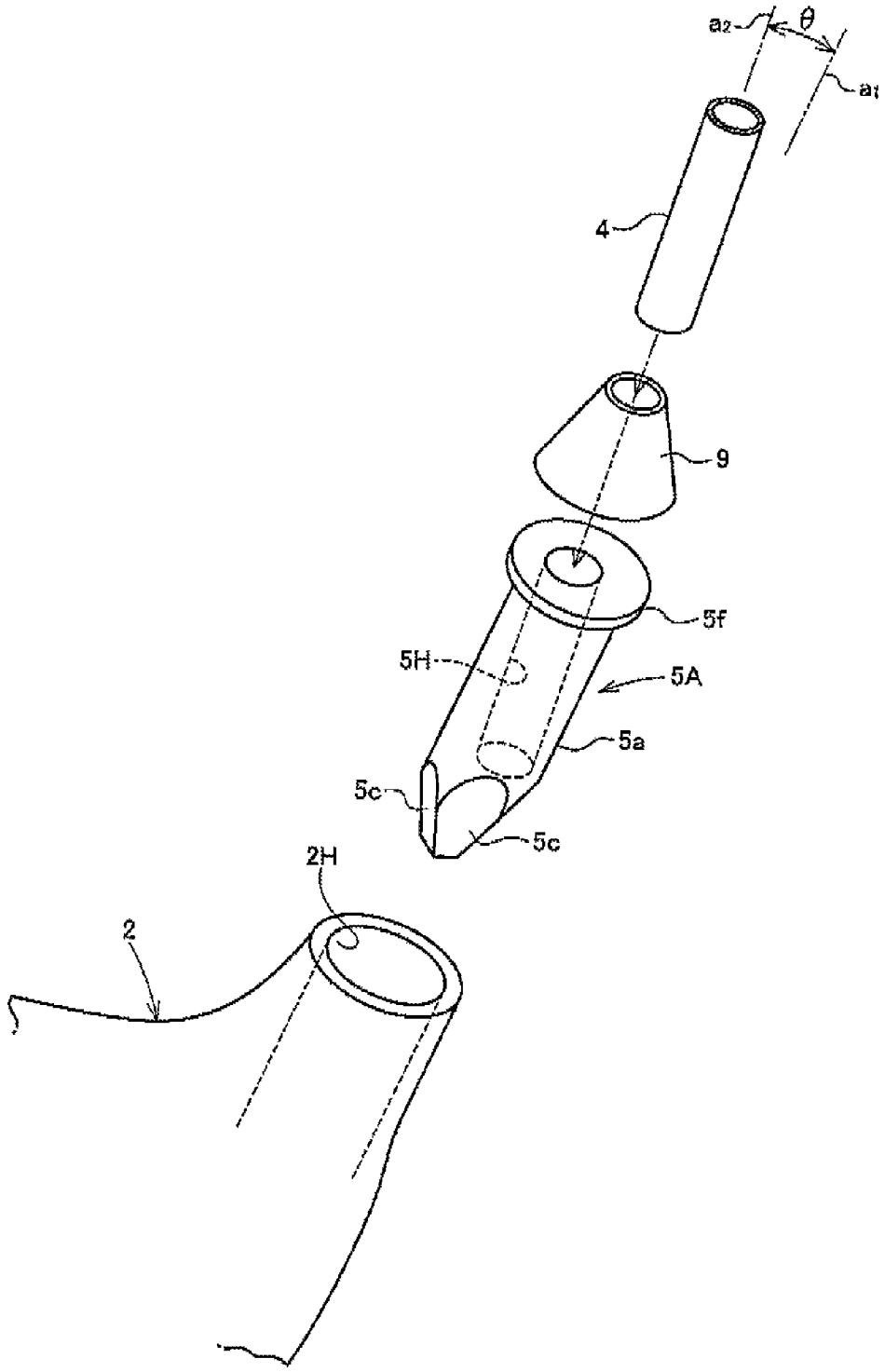
FIG. 5 is a perspective view of a hosel, a shaft holder and a screw member of a head relating to a second embodiment.

In a second embodiment, a shaft holder 5A of FIG. 5 is one in which the axis center direction of the shaft inserting hole 5H is sloped with respect to the axis center direction of the outer peripheral surface of the shaft holder 5A and the shaft holder inserting hole 2H.

In the embodiment of FIG. 5, an axis center line $a_2$ of the shaft 4 and the shaft inserting hole 5H obliquely intersects with an axis center line $a_1$ of the outer peripheral surface of the shaft holder inserting hole 2H and the shaft holder 5A. It is desirable that an intersecting angle θ of the axis center lines $a_1$ and $a_2$ be about 0.1 to 5.0°, particularly, about 0.25 to 3.0°. A position where the axis center lines $a_1$ and $a_2$ intersect each other may be an upper part of the shaft inserting hole 5H, and may be a lower part and a middle part thereof. When they intersect at the upper part, the upper end of the shaft inserting hole 5H is situated at the center of the upper end surface of the shaft holder 5A, so that the ferrule 9 takes a substantially regular conical shape, and the appearance thereof is satisfactory. When they intersect at the middle part, the intersecting angle θ can increase even if the shaft holder 5A is made thinner.

In addition, the axis center lines $a_1$ and $a_2$ may not intersect, but may be in a relationship, of "misalign". That is, the axis center lines $a_1$ and $a_2$ may be in a relationship in which the axis center line $a_2$ escapes through the vicinity of the axis center line $a_1$ without intersecting. As for the angles of the axis center lines $a_1$ and $a_2$ in this case, the axis center line $a_2$ may be set in a state of being sloped to the outermost heel side, and a plane extending in a flight ball line direction including axis center line $a_1$ is assumed, whereby the intersecting angle of this plane and the axis center line $a_2$ is in the range of the angle θ.

Figure 6A:
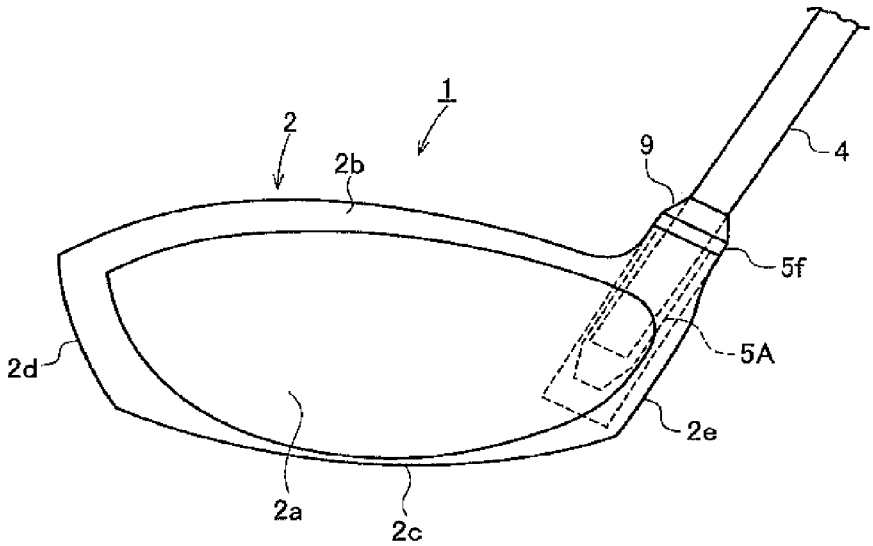
FIGS. 6A and 6B are front views of a head of a golf club which uses the head of FIG. 5.
Figure 6B:
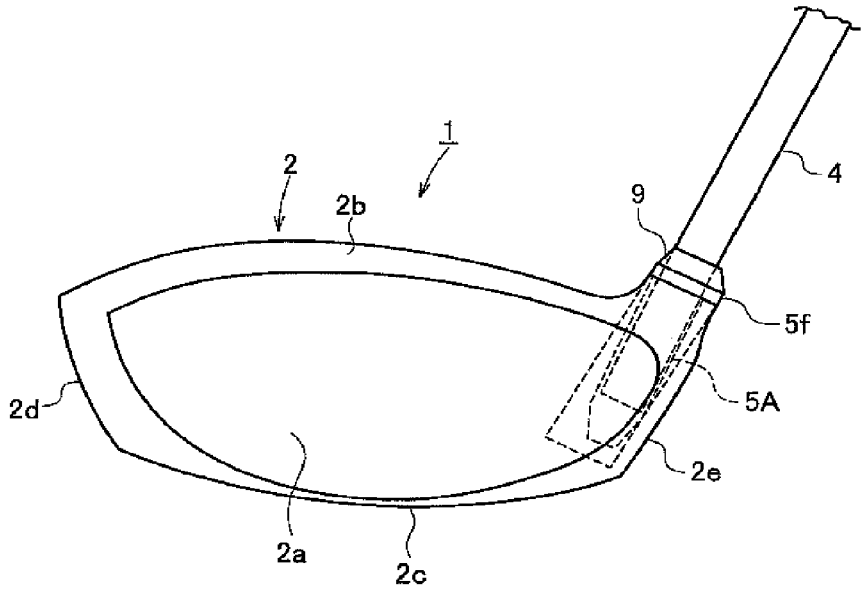

As shown in FIG. 5, in the golf club using the shaft holder 5A in which the shaft holder inserting hole 2H is sloped with respect to the hosel axis center, by changing the phase of the shaft holder 5A, as shown in FIGS. 6A and 6B, the slope direction of the shaft 4 can be changed. In FIG. 6A, the shaft 4 slopes to the outermost heel side. In FIG. 6B, the shaft 4 slopes to the outermost toe side.

In this manner, by changing the slope direction of the shaft 4, the lie angle and the slice angle can be changed.

Regarding the lie angle, it is the minimum in FIG. 6A and a flat lie, and it is the maximum in FIG. 6B and is an up lie.

Regarding the slice angle, in a state of being sloped to the most face surface (not shown), it becomes a hook face in which the face surface is closed the most, and on the contrary, by being sloped backward the most (not shown), it becomes a slice face in which the face surface is opened the most.

In this manner, by using the shaft holder 5A, the slope direction of the shaft 4 relative to the head 1 can be changed, which makes it possible to change the lie angle and the slice angle.

In addition, since the elastic body 8 with the slice shape formed of a rubber, an elastomer, a synthetic resin or the like is interposed between the shaft holders 5 and 5A and the shaft holder inserting hole 2H, a shock or a vibration at the time of impact can be absorbed. However, the elastic body 8 may be omitted.

In the present embodiment, since the inner surface of the inner side of the shaft holder inserting hole 2H and the outer surface of the lower end side of the shaft holder 5 and 5A are formed to the slope surfaces with regular polygonal pyramid shapes, respectively to engage the slope surfaces, the rattling is reduced and the rotation of the shaft 4 around the axis center in the circumferential direction is prevented. That is, a fixing rigidity of the shaft 4 in a torque direction is improved.

In addition, since the front end sides of the shaft holders 5 and 5A are formed in the shape of a taper, it is easy to insert them into the holder inserting hole 2H, respectively.

Figure 7A:
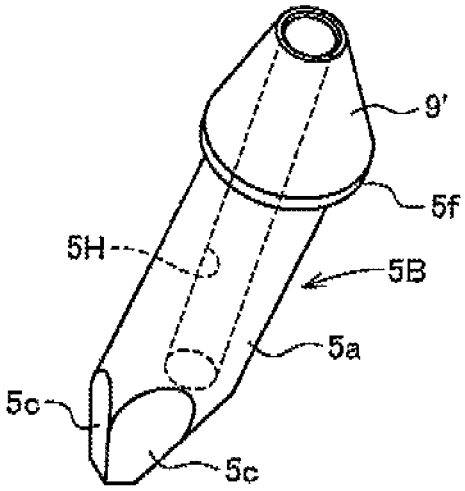
FIGS. 7A and 7B are a perspective view and a sectional view of a shaft holder which is used in a third embodiment.
Figure 7B:
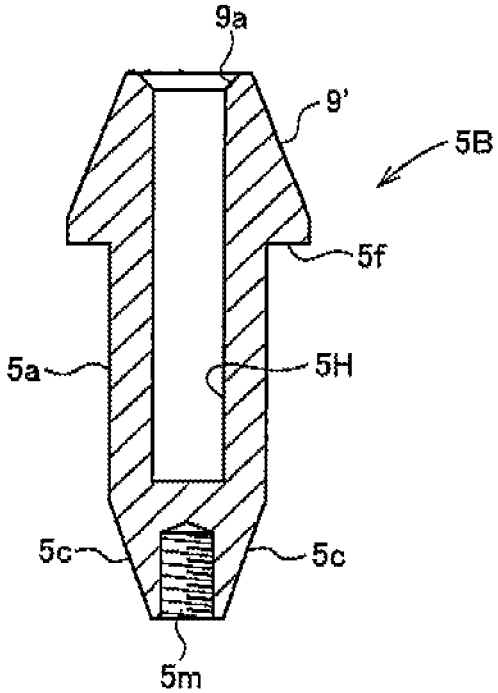

FIG. 7A is a perspective view of a shaft holder 5B which is used in a third embodiment, and FIG. 7B is a sectional view along an axis center line of the shaft holder 5B.

In each of the above-mentioned embodiments, although the ferrule 9 and the shaft holders 5 and 5A are separated from each other, as in the shaft holder 5B in the present embodiment, the ferrule portion 9' may integrally formed with the shaft holder 5B.

In the present embodiment, the shaft holder 5B is a cylindrical member which is fitted into the shaft holder inserting hole 2H (not shown in FIGS. 7A and 7B), and a shaft inserting hole 5H for inserting the shaft 4 is provided from the upper end side toward the lower end side. An inner peripheral surface of the shaft inserting hole 5H is a cylindrical shape as a whole. An outer peripheral surface of the shaft holder 5B is a cylindrical portion 5*a* except for the upper part and the lower part. An outer surface of the lower end side of the shaft holder 5B is a square pyramid which is reduced in diameter as it goes to the lower end, and slope surfaces 5*c* of the four surfaces are provided. A flange 5*f* is provided on the upper end of the cylindrical portion 5*a*.

In the present embodiment, the ferrule portion 9' is integrally formed on the upper surface side of the flange 5*f*. The ferrule portion 9' is a substantially tapered and truncated conical shape. The axis center line of the outer peripheral surface (a conical shape portion) of the ferrule portion 9' substantially coincides with the axis center line of the shaft inserting hole 5H. The upper end side of the shaft inserting hole 5H is opened to the upper end surface of the ferrule 9'. On the inner peripheral edge of the upper end surface of the ferrule 9', a bevel portion 9*a* with an angle of about 20 to 45° (FIG. 7B) is formed for making it easy to insert the shaft 4 into the shaft inserting hole 5H.

Other configurations of the shaft holder 5B are the same as the shaft holder 5A in FIGS. 5, 6A and 6B.

When the golf club is assembled by the use of the shaft holder 5B, the front end of the shaft 4 is inserted from the upper end side of the ferrule 9' into the shaft inserting hole 5H to form the connection body of the shaft holder and the shaft, so that the shaft holder 5B of the connection body of the shaft holder and the shaft is inserted into the shaft holder inserting hole 2H.

In the shaft holder 5B, since the ferrule 9' is integrally formed with the shaft holder 5B, when constructing the connection body of the shaft holder and the shaft, it is not necessary to fit the ferrule 9 to the front end of the shaft 4 prior to the shaft holder 5B. For that reason, the assembling process of the connection body of the shaft holder and the shaft is simplified and the leaving out of the ferrule 9 is also prevented.

In the present embodiment, since the bevel portion 9*a* is formed on the inner peripheral surface of the upper end surface of the ferrule portion 9', it is easy to insert the front end of the shaft 4 to the shaft inserting hole 5H.

Other configurations of the golf club head which uses the shaft holder 5B are the same as the second embodiment.

In addition, in the same manner as the shaft holder 5A in the second embodiment, the shaft holder 5B in the embodiment slopes the axis center line of the shaft inserting hole 5H with respect to the outer peripheral surface of the shaft holder 5B and the axis center line of the shaft holder inserting hole 2H. However, in the same manner as the shaft holder 5 in the first embodiment, the axis center line of the shaft inserting hole 5H may be disposed parallel to the axis center line of the shift holder 5B with a predetermined distance gap.

Figure 8:
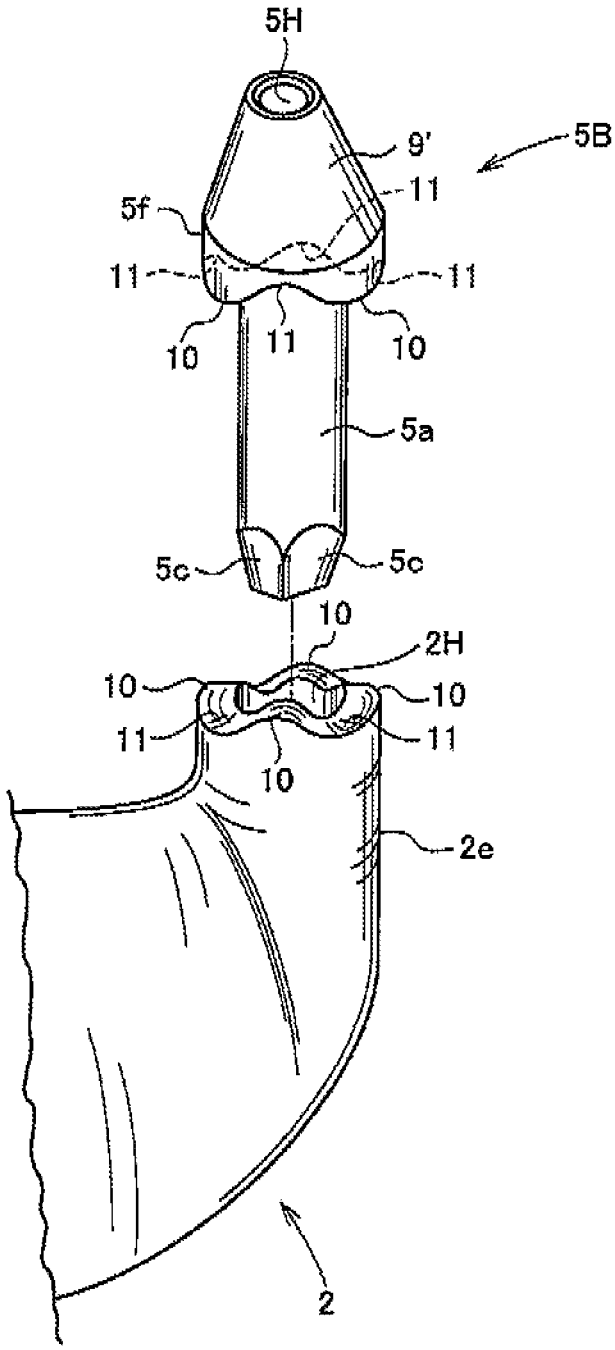
FIG. 8 is an exploded perspective view of a head main body and a shaft holder of a head relating to a fourth embodiment.

FIG. 8 is an exploded perspective view of a head main body 2 and a shaft holder 5B of a head relating to a fourth embodiment.

In the present embodiment, a plurality of convex portions 10 and concave portions 11 which can be engaged with each other is respectively provided on a peripheral edge portion of a shaft holder inserting hole 2H and a lower surface of the flange 5*f*. In the peripheral edge portion of the shaft holder inserting hole 2H and the lower surface of the flange 5*f*, each convex portion 10 is disposed in a circumferential direction of the shaft holder inserting hole 2H with a predetermined distance, and the adjacent convex portions 10 and 10 among the peripheral edge portion of the shaft holder inserting hole 2H and the lower surface of the flange 5*f* are the concave portions 11, respectively. When the shaft holder 5B is inserted to the shaft holder inserting hole 2H so that each of the slope surfaces 5*c* and 2*k* overlap with each other, each concave portion 10 of the peripheral edge portion of the shaft holder inserting hole 2H is engaged with each concave portion 11 of the lower surface of the shaft 5*f*, and each convex portion 10 of the lower surface of the flange 5*f* is engaged with each concave portion 11 of the peripheral edge portion of the shaft holder inserting hole 2H.

In the present embodiment, on the peripheral edge surface of the shaft holder inserting hole 2H and the lower surface of the flange 5*f*, the convex portions 10 and the concave portions 11 are provided in the same number as the angle number (i.e., the number of the slope surfaces 5*c* and 2*k*) of the polygonal section shape portion of the lower end portion of the shaft holder 5B and the inner side of the shaft holder inserting hole 2H. That is, in the present embodiment, since the lower end side of the shaft holder 5B and the inner side of the shaft holder inserting hole 2H have the square pyramid shapes, respectively, on the peripheral edge surface of the shaft holder inserting hole 2H and the lower surface of the flange 5*f*, four convex portions 10 and concave portions 11 are respectively provided. However, when the lower end side of the shaft holder 5B and the inner side of the shaft holder inserting hole 2H have octagonal pyramid shapes, respectively, it is desirable that eight convex portions 10 and concave portions 11 be respectively provided on the peripheral edge portion of the shaft holder inserting hole 2H and the lower surface of the flange 5*f*.

In the present embodiment, as shown in FIG. 8, the peripheral edge portion of the shaft holder inserting hole 2H and the lower surface of the flange 5*f* are uneven surfaces which are curved in the shape of a wave so as to smoothly fasten the front end portion of each convex portion 10 and the deepest portion of each concave portion 11 respectively in the circumferential direction of the shift holder inserting hole 2H. When each convex portion 10 and each concave portion 11 of the peripheral edge portion of the shaft holder inserting hole 2H are engaged with each convex portion 10 and each concave portion 11 of the lower surface of the flange 5*f*, the peripheral edge portion of the shaft holder inserting hole 2H and the lower surface of the flange 5*f* come into close contact with each other over the overall periphery. Furthermore, the shapes (shapes of each convex portion 10 and concave portion 11) of the peripheral edge portion of the shaft holder inserting hole 2H and the lower surface of the flange 5*f* are not limited thereto. For example, the peripheral edge portion of the shaft holder inserting hole 2H and the lower surface of the flange 5*f* may be uneven surfaces which include convex portions 10 and concave portions 11 with angled shapes such as saw teeth and clamps. The convex portions 10 may only be provided on one side of the peripheral edge portion of the shaft holder inserting hole 2H and the lower surface of the flange 5*f*, and concave portions 11 may only be provided on the other side thereof. A packing (not shown) may be interposed between the peripheral edge portion of the shaft holder inserting hole 2H and the lower surface of the flange 5*f*.

Other configurations of the present embodiment are the same as the third embodiment, and the shaft holder 5B is fixed to the bolt 6 (not shown in FIG. 8) which is inserted to the shaft holder inserting hole 2H.

In the present embodiment, when the shaft holder 5B is inserted into the shaft holder inserting hole 2H, in addition to the overlapping of each slope surface 5*c* of the lower end side of the shaft holder 5B and each slope surface 2*k* of the inner side of the shaft holder inserting hole 2H, since each convex portion 10 and each concave portion 11 of the peripheral edge portion of the shaft holder inserting hole 2H are engaged with each concave portion 11 and each convex portion 10 of the lower surface of the flange 5*f*, a rotation preventing effect of the shaft 4 in a direction around the axis center of the shaft holder, that is, fixing rigidity of the shaft holder in a torque direction is improved.

Furthermore, in the present embodiment, the convex portions 10 and the concave portions 11 are respectively provided in the same number as the slope surfaces 5*c* and 2*k* on the peripheral edge portion of the shaft holder inserting hole 2H and the lower surface of the flange 5*f*. Thus, if the shaft holder 5B is inserted into the shaft holder inserting hole 2H while matching the phase of the shaft holder 5B so that each convex portion 10 of one side of the peripheral edge portion of the shaft holder inserting hole 2H and the lower surface of the flange 5*f* confronts each concave portion 11 of the other side thereof, each of the slope portions 5*c* and 2*k* automatically overlap each other. As a result, when the lower end side of the shaft holder 5B is inserted into the shaft holder inserting hole 2H, even if it is difficult to see each of the slope surfaces 5*c* and 2*k*, the phase matching of the shaft holder 5B can easily be performed while seeing the convex portions 10 and the concave portions 11.

FIG. 8 shows an embodiment in which the convex portions 10 and the concave portions 11 engaged with each other are respectively provided on the lower surface of the flange 5*f* of the shaft holder 5B and the peripheral edge portion of the shaft holder inserting hole 2H in the seventh embodiment using the shaft holder 5B. However, even the first to fourth embodiments using the above-mentioned shaft holder 5 and the fifth and sixth embodiments using the shaft holder 5A can have the same configurations as those of FIG. 8.

In the present invention, the exchange of the shaft of the golf club can also easily be performed. When performing the shaft exchange, a shaft holder with the same shape as the shaft holder 5 is fixed to a new shaft to be exchanged by the adhesive in advance.

The bolt 6 of the existing golf club is removed to detach the old shaft 4 together with the shaft holder 5 from the head 1. Next, a new shaft with a shaft holder (the connection body of the shaft holder and the shaft) is inserted to the shaft holder inserting hole 2H and is fixed by screwing the bolt 6 into the male screw hole 5*m*.

In this manner, the attachment or the exchanging of the shaft can be performed extremely simply and rapidly. Furthermore, in the related art, it is configured so that the hosel portion of the existing golf club is heated to destroy the structure of the adhesive hardening product when exchanging the shaft, after the shaft is pulled out, and then a new shaft is fixed by the adhesive. Thus, time of the range of a few hours to one day is taken. However, in the present embodiments, by attaching the shaft holder 5 to a new shaft with the adhesive in advance, the shaft exchanging can be performed in a few minutes. Thus, a using method can be realized in which the shaft of various specs with the shaft holder attached thereto is prepared, and the different shafts are sequentially attached to the same head main body to perform a trial shot.

Furthermore, the shaft holder in which the slope angle θ of the shaft inserting hole 5H differs variously may be produced. For example, by preparing a plurality of types of hosel groups in which the angle θ gradually changes such as 0.5°, 1°, 1.5°, 2°, 2.5° and 3° as an exchanging shaft holder, it is possible to gradually change the lie angle or the slice angle to perform the trial shot.

It is desirable that the shaft holder be made of metal, particularly, be made of aluminum or titanium or alloy thereof. It is desirable that the shaft holder be made of the same material, as the head main body or a material with a specific gravity lower than the material of the head main body. For example, titanium alloy, aluminum, aluminum alloy, magnesium alloy, FRP, synthetic resin or the like may be used.

Although the material of the head is not particularly limited, in the case of a wood type golf club head, for example, titanium alloy, aluminum alloy, stainless or the like can be used.

In the present invention, the head main body is formed of stainless steel or titanium alloy, the shaft holder is aluminum alloy and is desirably made to be hard (Hv 250 to 600, preferably, Hv 400 or more by a hard alumite treatment) by an anodic treatment. The bolt for fixing the shaft holder to the head main body is desirably steel subjected to chrome plating (for example, stainless steel. However, the material of the bolt is not limited thereto). This is to prevent abrasion resistance from being highly damaged by to repeatedly adjusting the angle.

A plurality of slope surfaces are provided in the shaft holder and the shaft holder inserting hole so as to form the regular polygonal pyramid shape in the above-mentioned embodiment. However, the front end side of the shaft holder and the inner portion of the shaft holder inserting hole may be formed in the shape of a concave polygonal section such as star shape or in the shape of a gear teeth section.

Although the golf club head is a wood type in the above-mentioned embodiments, the present invention can also be applied to any type of golf club head of a utility type, an iron type, and a putter type.

In addition, in the case of the hollow type golf club head, by providing the shaft holder 5 and the bolt 6, the weight of the heel side is larger than a general golf club head. For that reason, by increasing the thickness of the toe or the back portion or providing a weight on the toe side, the golf club head balance may be obtained.

Figure 9A:
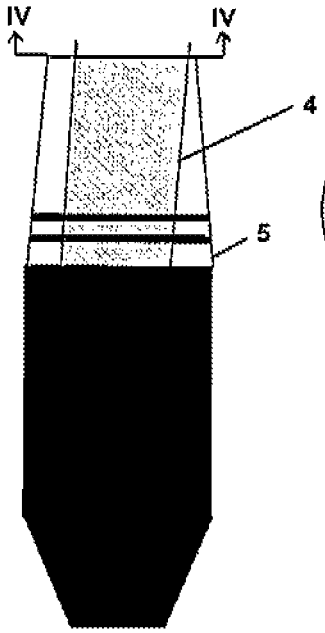
FIGS. 9A to 9D are views exemplary showing configurations that a shaft is inserted into the a shaft holder at an angle.
Figure 9B:
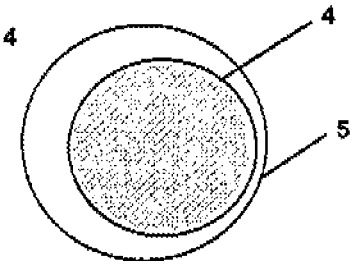
Figure 9C:
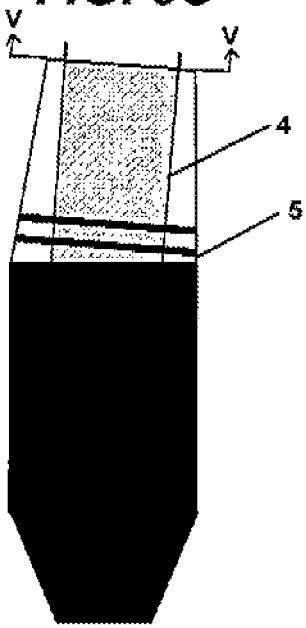
Figure 9D:
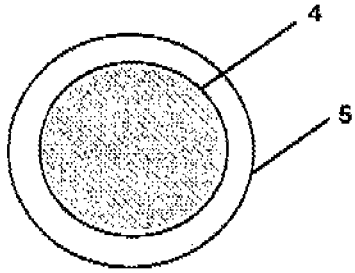

In addition, in a case that the shaft 4 is inserted into the shaft holder 5 at an angle as shown in FIG. 9A, the shaft 4 may be eccentrically-fixed to the shaft holder 5 as shown in FIG. 9B. Besides, FIG. 9B is a sectional view taken from line IV-IV in FIG. 9A. On the other hand, an upper portion of the shaft holder 5 may be provided at an angle according to an insertion angle of the shaft 4 as shown in FIG. 9C. In this configuration, the shaft 4 can be concentrically-fixed to the shaft holder 5 as shown in FIG. 9D. Besides, FIG. 9D is a sectional view taken from line V-V in FIG. 9C.

What is claimed is:

1. A golf club head comprising:

a head main body having a shaft holder inserting hole;

a shaft holder which has a shaft inserting hole and is attachably and detachably installed in the shaft holder inserting hole;

a bolt inserting hole which penetrates from a sole side of the head main body to the shaft holder inserting hole;

a bolt which is inserted into the bolt inserting hole, screwed into the shaft holder, and fixes the shaft holder to the head main body, an axis center of the shaft inserting hole and an axis center of the shaft holder inserting hole being non-coaxial shapes; and an elastic body interposed between a regular polygonal pyramid portion of the shaft holder and a regular polygonal pyramid portion of the shaft holder inserting hole, wherein a lower end side of the shaft holder and an inner portion of the shaft holder inserting hole are polygonal sectional shape portions and are engaged with each other;

an inner peripheral surface of an upper portion of the shaft holder inserting hole and an outer peripheral surface of an upper portion of the shaft holder are respectively cylindrical portions; and lower sides of the cylindrical portions are regular polygonal pyramid portions that shrink toward a lower part.

2. The golf club head according to claim 1, wherein the axis center of the shaft inserting hole is parallel to the axis center of the shaft holder inserting hole, and the axis center of the shaft inserting hole is separated from the axis center of the shaft holder inserting hole by a predetermined distance.

3. The golf club head according to claim 1, wherein the axis center of the shaft inserting hole is inclined with respect to the axis center of the shaft holder inserting hole.

4. The golf club head according to claim 1, further comprising a flange provided on the upper part of the shaft holder, the flange being in contact with a peripheral edge portion of the shaft holder inserting hole.

5. The golf club head according to claim 4, further comprising convex portions protrude from one side of the peripheral edge portion of the shaft holder inserting hole and the lower surface of the flange toward the other side thereof, and concave portions engaged with the convex portions are formed on the other side, wherein the convex portions and the concave portions are respectively provided with gaps in a circumferential direction of the shaft holder inserting hole.

6. The golf club head according to claim 5, wherein the convex portions and the concave portions are respectively provided in the same numbers as those of angles of polygonal section shape portions of a lower end side of the shaft holder and an inner portion of the shaft holder inserting hole.

7. The golf club head according to claim 1, wherein the head main body is formed of stainless or titanium alloy; and the shaft holder is aluminum alloy and is formed with a hard coating by anodic treatment.

8. A golf club comprising:

a shaft;

a golf club head including:

a head main body having a shaft holder inserting hole;

a shaft holder which has a shaft inserting hole and is attachably and detachably installed in the shaft holder inserting hole;

a bolt inserting hole which penetrates from a sole side of the head main body to the shaft holder inserting hole;

a bolt which is inserted into the bolt inserting hole, screwed into the shaft holder, and fixes the shaft holder to the head main body, an axis center of the shaft inserting hole and an axis center of the shaft holder inserting hole being non-coaxial shapes; and an elastic body interposed between a regular polygonal pyramid portion of the shaft holder and a regular polygonal pyramid portion of the shaft holder inserting hole, wherein:

a lower end side of the shaft holder and an inner portion of the shaft holder inserting hole are polygonal sectional shape portions and are engaged with each other;

a front end of the shaft is inserted and fixed to the shaft inserting hole of the golf club head;

an inner peripheral surface of an upper portion of the shaft holder inserting hole and an outer peripheral surface of an upper portion of the shaft holder are respectively cylindrical portions; and lower sides of the cylindrical portions are regular polygonal pyramid portions that shrink toward a lower part.

9. A golf club head comprising:

a head main body having a shaft holder inserting hole;

a shaft holder which has a shaft inserting hole and is attachably and detachably installed in the shaft holder inserting hole;

a bolt inserting hole which penetrates from a sole side of the head main body to the shaft holder inserting hole;

a bolt which is inserted into the bolt inserting hole, screwed into the shaft holder, and fixes the shaft holder to the head main body, an axis center of the shaft inserting hole and an axis center of the shaft holder inserting hole being non-coaxial shapes;

convex portions protrude from one side of the peripheral edge portion of the shaft holder inserting hole and the lower surface of the flange toward the other side thereof, and concave portions engaged with the convex portions are formed on the other side; and a flange provided on the upper part of the shaft holder, the flange being in contact with a peripheral edge portion of the shaft holder inserting hole, wherein a lower end side of the shaft holder and an inner portion of the shaft holder inserting hole are polygonal sectional shape portions and are engaged with each other;

an inner peripheral surface of an upper portion of the shaft holder inserting hole and an outer peripheral surface of an upper portion of the shaft holder are respectively cylindrical portions;

lower sides of the cylindrical portions are regular polygonal pyramid portions that shrink toward a lower part; and the convex portions and the concave portions are respectively provided with gaps in a circumferential direction of the shaft holder inserting hole.

10. The golf club head according to claim 9, wherein the axis center of the shaft inserting hole is parallel to the axis center of the shaft holder inserting hole, and the axis center of the shaft inserting hole is separated from the axis center of the shaft holder inserting hole by a predetermined distance.

11. The golf club head according to claim 9, wherein the axis center of the shaft inserting hole is inclined with respect to the axis center of the shaft holder inserting hole.

12. The golf club head according to claim 9, wherein the convex portions and the concave portions are respectively provided in the same numbers as those of angles of polygonal section shape portions of a lower end side of the shaft holder and an inner portion of the shaft holder inserting hole.

13. The golf club head according to claim 9, wherein the head main body is formed of stainless or titanium alloy; and the shaft holder is aluminum alloy and is formed with a hard coating by anodic treatment.

14. A golf club head comprising:

a head main body having a shaft holder inserting hole;

a shaft holder which has a shaft inserting hole and is attachably and detachably installed in the shaft holder inserting hole;

a bolt inserting hole which penetrates from a sole side of the head main body to the shaft holder inserting hole;

a bolt which is inserted into the bolt inserting hole, screwed into the shaft holder, and fixes the shaft holder to the head main body, an axis center of the shaft inserting hole and an axis center of the shaft holder inserting hole being non-coaxial shapes; and convex portions protrude from one side of the peripheral edge portion of the shaft holder inserting hole and a lower surface of a flange toward the other side thereof, and concave portions engaged with the convex portions are formed on the other side, wherein the convex portions and the concave portions are respectively provided with gaps in a circumferential direction of the shaft holder inserting hole, wherein a lower end side of the shaft holder and an inner portion of the shaft holder inserting hole are polygonal sectional shape portions and are engaged with each other.

15. The golf club head according to claim 14, wherein the head main body has a hollow portion, the shaft is inserted toward the hollow portion and the bolt is screwed into the shaft holder without a gap.

16. The golf club head according to claim 14, wherein the shaft holder is made of the same material as the head main body or a material with a specific gravity lower than the material of the head main body.

17. The golf club head according to claim 14, wherein the head main body is made of stainless steel or titanium alloy, and the shaft holder is made of aluminum alloy hardened by an anodic treatment.

18. The golf club head according to claim 14, wherein the peripheral edge portion of the shaft holder inserting hole and the lower surface of the flange are uneven surfaces which are curved in the shape of a wave to smoothly fasten the front end portion of each convex portion and a deepest portion of each concave portion in a circumferential direction of the shaft holder inserting hole.

19. The gold club head according to claim 14, wherein the peripheral edge portion of the shaft holder inserting hole and the lower surface of the flange are uneven surfaces which include convex portions and concave portions having angled shapes.

20. The golf club head according to claim 14, wherein a packing is interposed between the peripheral edge portion of the shaft holder inserting hole and the lower surface of the flange.

* * * * *